United States Patent [19]

Mason

[11] Patent Number: 4,706,574

[45] Date of Patent: Nov. 17, 1987

[54] LOCKING REMOVABLE SUPPORT SURFACE AND ADAPTER

[76] Inventor: Robert L. Mason, 18724 Via Verona, Newport Beach, Calif. 92715

[21] Appl. No.: 922,024

[22] Filed: Oct. 22, 1986

[51] Int. Cl.[4] ..... A47B 57/00; A47B 5/00

[52] U.S. Cl. ..... 108/97; 108/152; 312/281

[58] Field of Search ..... 108/97, 152, 90, 47; 312/281, 282; 248/225.1, 339

[56] References Cited

U.S. PATENT DOCUMENTS

| | | | |
|---|---|---|---|
| 200,584 | 2/1878 | Terry | 108/97 |
| 2,401,182 | 5/1946 | Paxton et al. | 108/152 |
| 2,514,702 | 7/1950 | Lantz | 108/97 X |
| 2,788,438 | 4/1957 | Lieuwen | 248/339 X |
| 2,935,209 | 5/1960 | Fritz | 108/97 X |
| 3,044,197 | 7/1962 | Cook | 108/97 |
| 3,669,032 | 6/1972 | Gooderum | 108/97 |
| 3,680,235 | 8/1972 | Leemhuis | 108/152 X |
| 3,688,706 | 9/1972 | Meryweather | 108/97 |

*Primary Examiner*—Philip C. Kannan
*Attorney, Agent, or Firm*—Timothy T. Tyson

[57] ABSTRACT

A locking removable support surface such as an ironing board for use in a bread board slot in a cabinet or with an adapter. The inner end of the support surface has sides that taper away from each other. When the support surface is inserted into the slot, the sides wedge horizontally against the ends of the slot locking the support surface in place. The adapter allows the support surface to be used on a cabinet that does not have a slot or any vertical surface. A drawer is removed from the cabinet and the adaptor is inserted. The adapter has a slot for the support surface. One embodiment of the adapter has side walls that taper in to match the taper of the sides of the support surface to provide superior horizontal wedging. Another embodiment of the adapter has upper and lower walls tapering toward each other to provide vertical wedging of the inner end of the support surface.

11 Claims, 8 Drawing Figures

LOCKING REMOVABLE SUPPORT SURFACE AND ADAPTER

BACKGROUND OF THE INVENTION

1. Field of the Invention

The present invention pertains to the carpentry art, and more particularly, to a locking removable support surface for selectively positioning in a bread board slot or an adapter having a slot.

2. Background Art

As living spaces have become more compact, the remaining spaces become more important. Multiple uses are often required of a space necessitating greater organization of the structures that might be required for different activities.

One common structure found in most homes is the ironing board. It is usually stored in a closet and is unfolded and set up only when needed. The standard ironing board is bulky in both the folded and unfolded conditions having legs for supporting the horizontal ironing surface during use. However, ironing boards do not have to have legs and some consist only of a smooth surface and a soft pad. The board is then laid on an existing horizontal surface such as a cabinet or table for use. However, the legs do facilitate the ironing process by allowing the person using the board to stand closer to the board than is otherwise possible and to drape objects being pressed over or around the board.

Several ironing boards have been developed that use the wall or a cabinet to support the board in an extended position without the use of legs. The bulky and awkward legs are thereby eliminated allowing for much greater economy of space during storage and ease in moving the board from storage to set up. A board built into a wall or cabinet is disclosed in U.S. Pat. No. 1,300,993. Ironing boards for use on top of a cabinet drawer or extendable bread board are disclosed in U.S. Pat. Nos. 2,514,702; 3,669,032; and 3,688,706. Examples of boards for use on tops of cabinets and tables are disclosed in U.S. Pat. Nos. 2,326,062 and 2,652,646. All of these boards are subject to movement during use or require elaborate secondary structures to retain them in place.

SUMMARY OF THE INVENTION

The present invention is directed to a locking removable support surface which may be used either as an ironing board or for a more general purpose. The support surface may be positioned in a bread board slot or in an adapter inserted into a drawer slot or mounted on a vertical surface. The support surface locks securely into place by wedging and is then easily removed by moving gently from side to side out of the wedged position. Since the support surface utilizes an existing vertical structure for support, no legs are required which greatly eases storage and set up.

In accordance with one important aspect of the invention, the locking removable support surface has first and second sides and outer and inner ends. The support surface is installed by inserting the inner end in a slot. The first and second sides taper away from each other moving away from the inner end thereby providing a horizontal wedging means for locking the support surface against the slot ends when the support surface is pushed into the slot.

In accordance with another important aspect of the invention, an adapter is provided for those situations where a suitable bread board slot is not available or where the support surface is to be used on a vertical surface such as a wall or door. The adapter has a facing with a slot. When the support surface is to be used on an cabinet that does not have a suitable bread board slot, a drawer is removed from the cabinet and the adapter is installed in place of the drawer. The inner end of the support surface is then inserted into the slot in the adapter.

One feature of a preferred embodiment is an adapter having first and second side walls on either side of the facing slot tapering toward each other away from the facing. The side walls provide superior horizontal wedging between the adapter and the support surface particularly if the horizontal taper of the walls is the same as the horizontal taper of the sides of the support surface.

In a preferred embodiment, the adapter also has upper and lower walls tapering toward each other away from the facing to provide a vertical wedging means. When the support surface is then inserted into the slot, the inner end becomes vertically wedged between the upper and lower walls locking the support surface vertically in the adapter.

DESCRIPTION OF THE PREFERRED EMBODIMENTS

Figure 1:
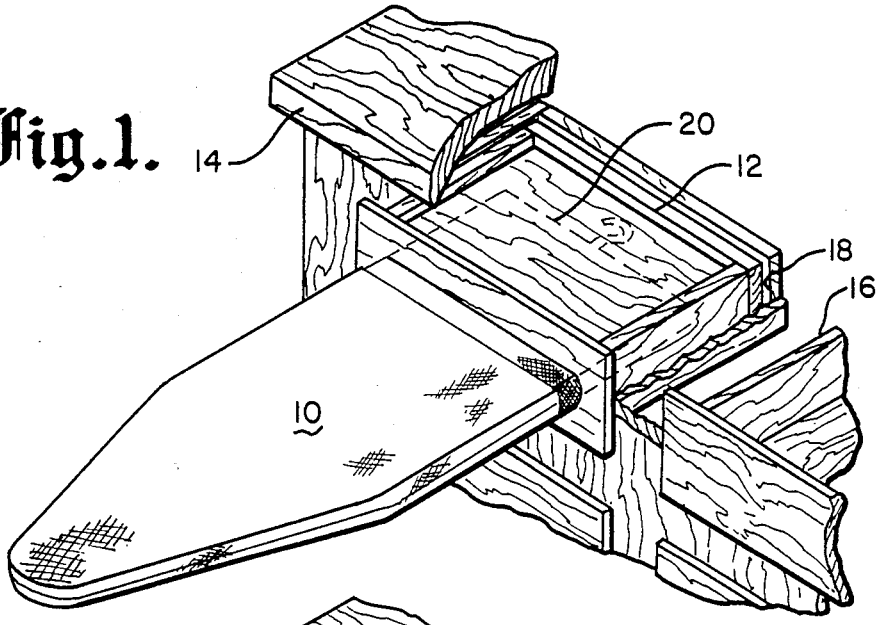
FIG. 1 is a perspective view of an ironing board embodiment of the invention mounted in a cabinet.

Referring initially to FIG. 1, there is illustrated a locking removable support surface in the form of an ironing board 10 with an adapter 12 of the present invention mounted in a cabinet 14. The adapter 12 is positioned in the cabinet 14 by removing one of the existing drawers similar to the drawer 16 to the right leaving an empty drawer slot 18. The adapter 12 is fabricated with outer dimensions similar to those of the removed drawer thereby allowing the adapter to easily slip into the drawer slot 18. Once the adapter 12 is in position inside the drawer slot 18, the inner end 20 of the ironing board 10 is inserted into the adapter thereby mounting the ironing board at a convenient height and in a convenient position ready for use.

Figure 2:
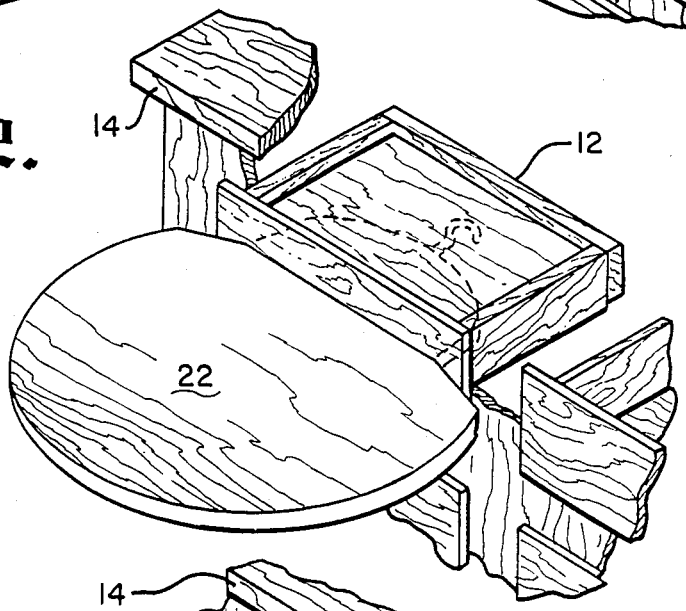
FIG. 2 is a perspective view similar to FIG. 1 with a round table embodiment mounted in a cabinet.

FIG. 2 is a perspective view similar to FIG. 1 having a support surface in the form of a round table 22 instead of the ironing board 10. The same adapter 12 may be used to mount either the ironing board 10 or the round table 22 in the cabinet 14. The round table 22 may be used as a small table for a single person or to partially block off the area in front of the cabinet 14 temporarily as might be desirable during a party while simultaneously providing additional working surface.

Figure 3:
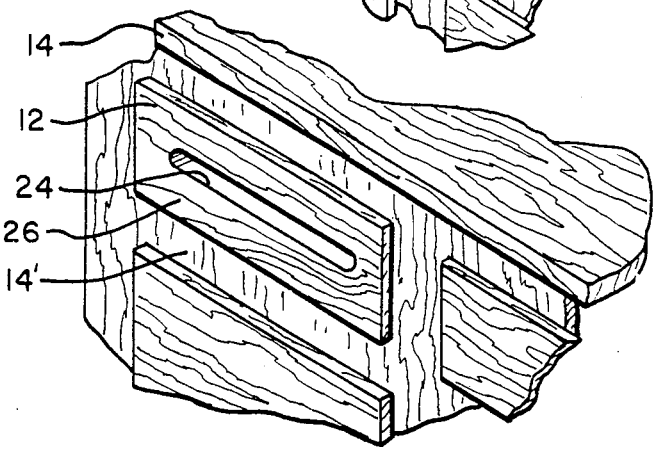
FIG. 3 is a perspective view similar to FIG. 1 with only the adapter mounted in the cabinet or, alternatively, of a cabinet having a preexisting bread board slot.

FIG. 3 is a perspective view similar to FIG. 1 with only the adapter 12 mounted in the cabinet 14. Alternatively, FIG. 3 may represent a permanent bread board slot 24 providing a support surface slot through the facing 26 of the cabinet 14' as is often found in present kitchens. The ironing board 10 of FIG. 1 or the round table 22 of FIG. 2 may be readily positioned in either the bread board slot 24 or the adapter 12.

Figure 4:
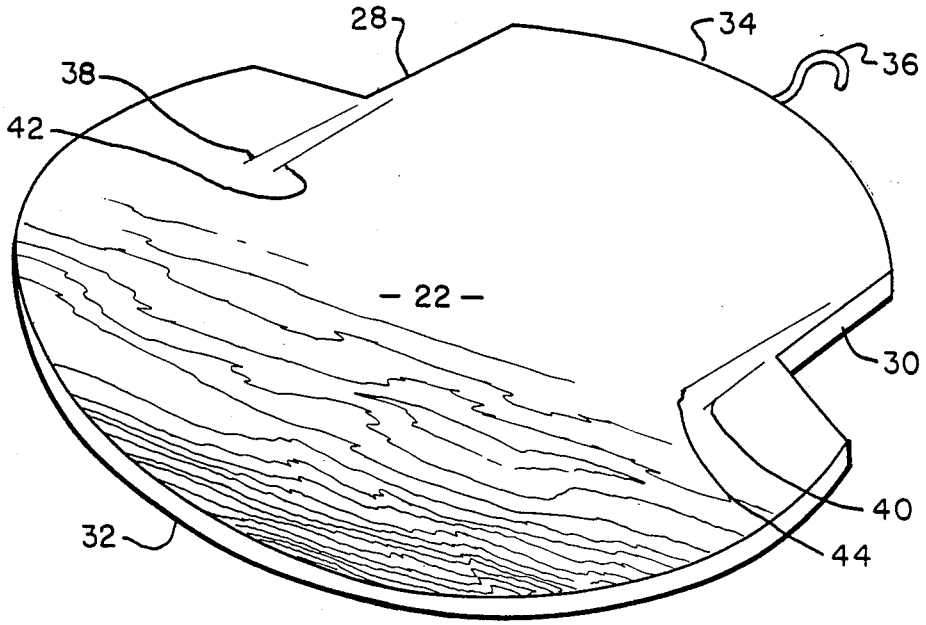
FIG. 4 is a perspective view of the round table support surface of FIG. 2.

FIG. 4 is a perspective view of the support surface having the round table 22 configuration of FIG. 2. The round table 22 has a first side 28, a second side 30, an outer end 32, an inner end 34, and a hook 36 on the inner end allowing the round table to be hung on a bar in a closet for storage. When the round table 22 is stored in this manner, the space required is little more than the space required for a coat and the round table is as easily accessible as is a coat. The first and second sides 28 and 30 taper away from each other from the inner end 34 toward the outer end 32 as indicated by the angle between the line 38 of the first side 28 and the line 40 of the second side 30. In comparison, the lines 42 and 44 are parallel and intersect the inner end 34 at the junctions of the inner end with the first and second sides 28 and 30, respectively. The divergence of the first and second sides 28 and 30 provides a horizontal wedging means for locking the round table 22 in the bread board slot 24 or the slot in the adapter 12 (FIG. 2) when the round table is pushed into the slots.

Figure 5:
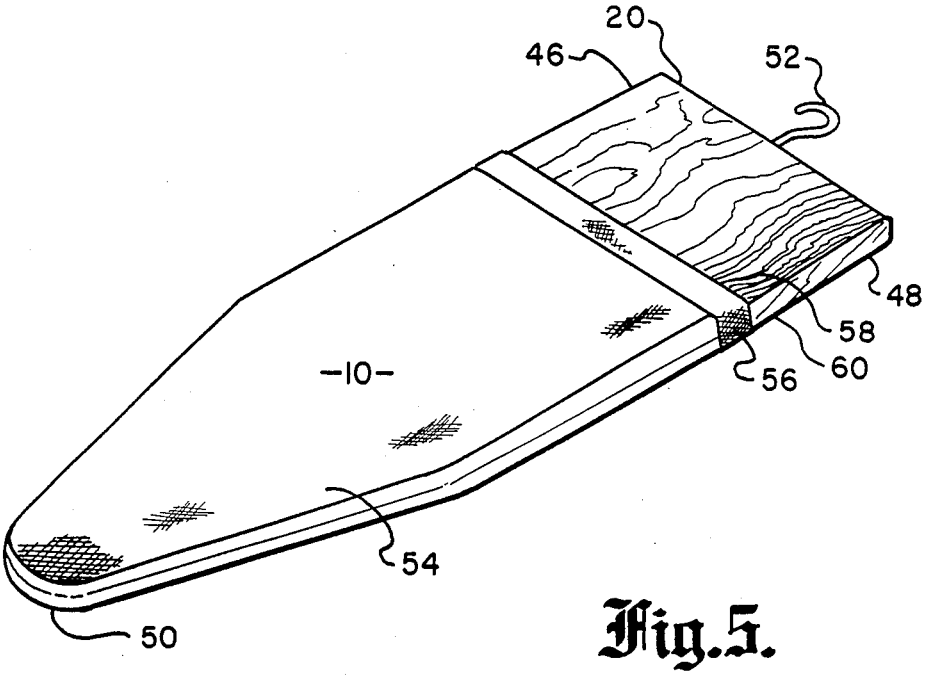
FIG. 5 is a perspective view of the ironing board support surface of FIG. 1.

FIG. 5 is a perspective view of the support surface having the ironing board 10 configuration of FIG. 1. The ironing board 10 also has a first side 46, a second side 48, an outer end 50, and a hook 52 on the inner end 20. As with the round table 22, the hook 52 allows the ironing board 10 to be hung on a bar in a closet for storage. Since no legs are present as found on stand alone ironing boards, significant space is saved inside the closet. The first and second sides 46 and 48 of the ironing board taper in a manner similar to the sides 28 and 30 illustrated in FIG. 4 thereby providing a horizontal wedging means to allow the ironing board 10 to be securely locked into a slot by pushing the board into the slot. The ironing board 10 also has a pad 54 secured by a tape 56 and mounted on its upper surface 58 for providing a soft surface appropriate for ironing. If desired, a vertical wedging means is provided by having the upper surface 58 and the lower surface 60 taper away from each other from the inner end 20 toward the outer end 50. Then when the ironing board 10 is pushed into a slot, the upper and lower surfaces 58 and 60 will wedge vertically against the slot locking the board in place.

Figure 6:
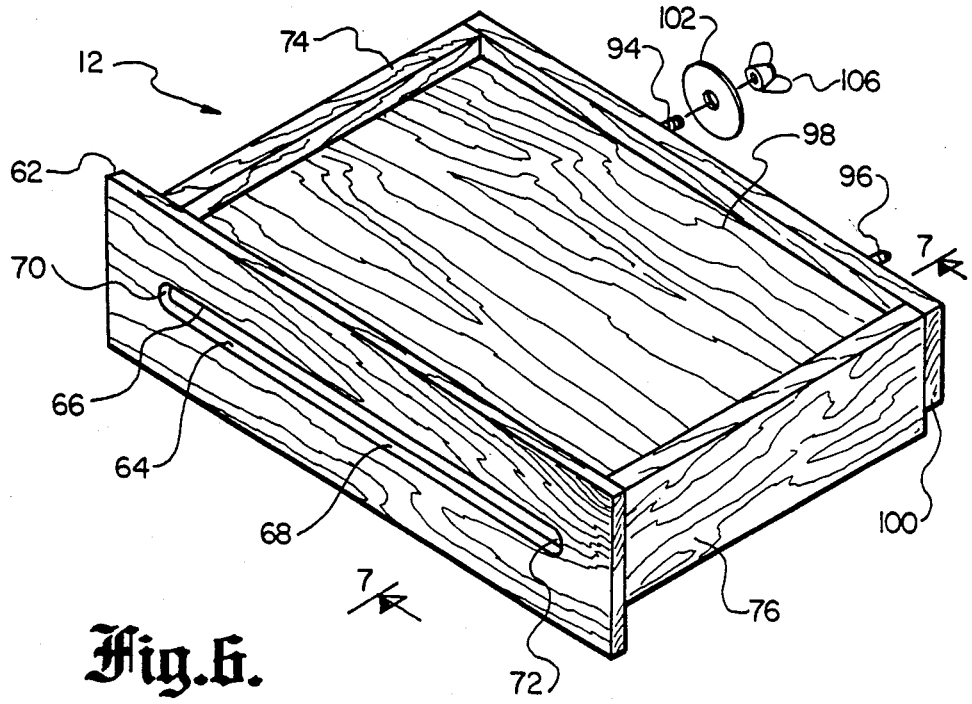
FIG. 6 is a perspective view of the adapter.
Figure 7:
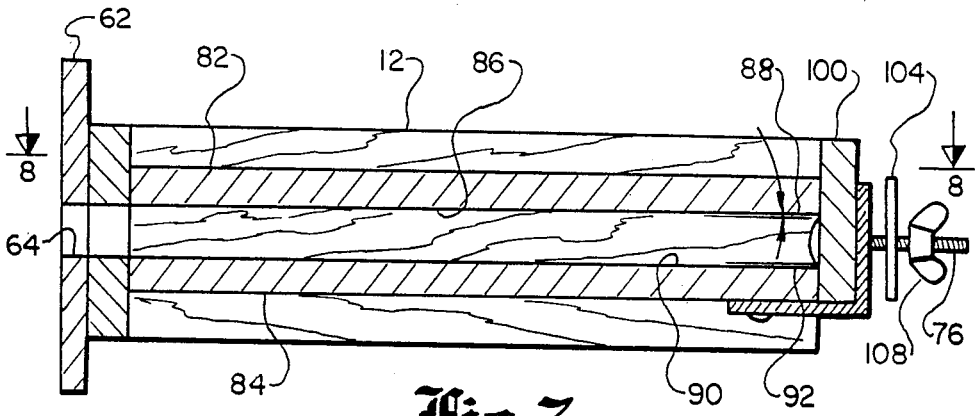
FIG. 7 is a sectional view along the line 7—7 of FIG. 6.
Figure 8:
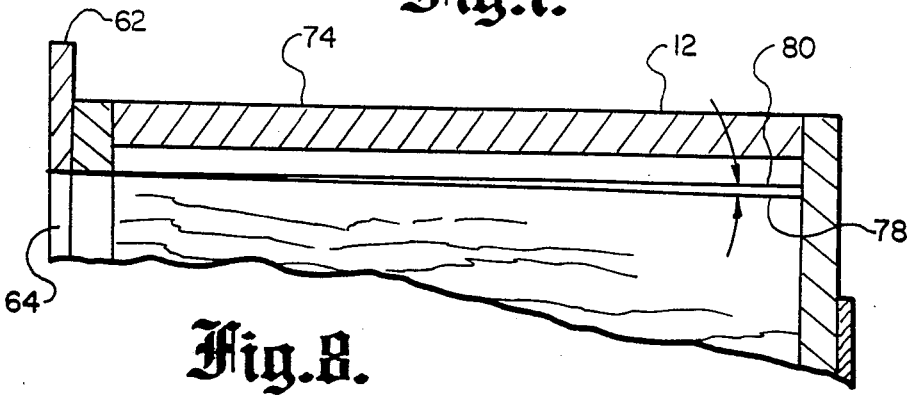
FIG. 8 is a partial sectional view along the line 8—8 of FIG. 7.

FIG. 6 is a perspective view of the adapter 12 of FIGS. 1 and 2. FIG. 7 is a sectional view along the line 7—7 of FIG. 6 and FIG. 8 is a partial sectional view along the line 8—8 of FIG. 7. The adapter 12 has a facing 62 with a support surface slot 64 therethrough. The support surface slot 64 has an upper slot surface 66, a lower slot surface 68 spaced from the upper slot surface, a first end 70, and a second end 72 spaced from the first end. When the inner end 20 of the ironing board 10 of FIG. 5 is inserted into the support surface slot 64, the first side 46 butts against the first end 70 and the second side 48 butts against the second end 72 wedging the ironing board 10 horizontally in the slot and locking the board in the adapter 12.

The adapter 12 also has a first side wall 74 coupled to the facing 62 adjacent the first end 70 and a second side wall 76 coupled to the facing adjacent the second end 72. The side walls 74 and 76 have dimensions similar to the dimensions of the drawer that is removed from the cabinet 14 as discussed above in conjunction with FIG. 1. The side walls 74 and 76 position and hold the adapter 12 in the empty drawer slot 18 in the same position as the drawer.

The side walls 74 and 76 also taper toward each other away from the facing 62 preferrably at an angle similar to the taper angle on the round table 22 represented by the angle between the lines 38 and 40 in FIG. 4. The taper on one side of the adapter 12 is best shown in FIG. 8. The inner side 78 of the first side wall 74 tapers away from a line 80 perpendicular to the facing 62 toward the center of the adapter 12. The combined taper of the first and second side walls 74 and 76 is double the angle between the inner side 78 and the line 80. If the taper of the round table 22 and the taper in the adapter 12 are the same, the first and second sides 28 and 30 of the round table 22 are horizontally wedged along a much longer length of the adapter than if the horizontal wedging occurs only between the first and second ends 70 and 72 of the support surface slot 64 (FIG. 6). A superior horizontal locking between the round table 22 and the adapter 12 is thereby provided.

The adapter 12 also has an upper wall 82 coupled to the facing 62 adjacent the upper slot surface 66 and between the first and second side walls 74 and 76. A lower wall 84 is spaced from the upper wall 82 and is coupled to the facing 62 adjacent the lower slot surface 64 and also between the first and second side walls 74 and 76. The upper and lower walls 82 and 84 taper toward each other away from the facing 62 as shown in FIG. 7 to provide another means for vertically wedging a support surface in the adapter 12. The inner side 86 of the upper wall 82 tapers away from a line 88 that is perpendicular to the facing 62 toward the center of the adapter. The inner side 90 of the lower wall 84 tapers away from a line 92 that is also perpendicular to the facing 62 toward the center of the adapter. The combined vertical taper of the upper and lower walls 82 and 84 is the angle between the inner sides 86 and 90. When a support surface such as the ironing board 10 is inserted into the support surface slot 64, the inner end 20 (FIG. 5) travels between the upper and lower walls 82 and 84 until it becomes vertically wedged between them thereby locking the ironing board in the adapter 12.

As noted in conjunction with FIG. 5, the upper and lower surfaces 58 and 60 of the ironing board 10 may be tapered away from each other from the inner end 20 toward the outer end 50 to provide a vertical wedging means. Preferably this vertical taper angle is the same as the vertical taper angle between the upper and lower walls 82 and 84 in the adapter 12. If the vertical taper of the ironing board 10 and the vertical taper in the adapter 12 are the same, the upper and lower surfaces 58 and 60 are vertically wedged along a much longer length of the adapter than if the vertical wedging occurs only at the upper and lower slot surfaces 66 and 68 of the support surface slot 64 (FIG. 6). A superior vertical locking between the ironing board and the adapter is thereby provided.

FIGS. 6 and 7 also illustrate a coupling means in the form of bolts 94 and 96 for installing the adapter 12 on any vertical surface such as a door or a wall. The utility of the support surface and adapter 12 of the present invention are thereby extended to any location having a vertical surface instead of being dependent upon a cabinet having a drawer. In such a situation, the upper adapter surface 98 serves as a convenient shelf when a support surface is not needed. The bolts 94 and 96 are mounted perpendicular to a rear wall 100. The rear wall 100 is spaced from the facing 62 and is coupled to the first and second side walls 74 and 76. All that is required to mount the adapter 12 are suitable holes drilled through the vertical surface. The bolts 94 and 96 are then inserted through the holes and washers 102 and 104 and wing nuts 106 and 108 installed on the bolts to complete the installation.

In view of the above, it may be seen that several embodiments of locking removable support surfaces and adapters are provided. Of course, the structures may be variously implemented depending upon specific applications. Accordingly, the scope hereof shall not be referenced to the disclosed embodiments, but on the contrary, shall be determined in accordance with the claims as set forth below.

I claim:

1. A locking removable support surface with adapter, comprising:

said adapter having:

a facing having a support surface slot therethrough having:

an upper slot surface, a lower slot surface spaced from said upper slot surface, a first end, and a second end, spaced from said first end;

a first side wall coupled to said facing adjacent said first end of said support surface slot; and a second side wall coupled to said facing adjacent said second end of said support surface slot; and said support surface selectively insertable in said support surface slot.

2. A locking removable support surface with adapter according to claim 1 wherein said locking removable support surface includes:

first and second sides;

outer and inner ends; and said inner end for selectively inserting into said support surface slot; and further including:

wedging means for selectively locking said support surface in said adapter.

3. A locking removable support surface with adapter according to claim 2 wherein said wedging means includes said first and second sides tapering away from each other from said inner end toward said outer end.

4. A locking removable support surface with adapter according to claim 2 wherein said wedging means includes said first and second side walls tapering toward each other away from said facing.

5. A locking removable support surface with adapter according to claim 1 wherein said adapter further includes:

an upper wall coupled to said facing adjacent said upper slot surface and between said first and second side walls; and a lower wall spaced from said upper wall and coupled to said facing adjacent said lower slot surface and between said first and second side walls.

6. A locking removable support surface with adapter according to claim 5 wherein said support surface has upper and lower surfaces and outer and inner ends, said inner end for selectively inserting into said support surface slot, and further including wedging means for selectively locking said support surface in said adapter.

7. A locking removable support surface with adapter according to claim 6 wherein said wedging means includes said upper and lower surfaces tapering away from each other from said inner end toward said outer end.

8. A locking removable support surface with adapter according to claim 6 wherein said wedging means includes said upper and lower walls tapering toward each other away from said facing.

9. A locking removable support surface with adapter according to claim 8 wherein said support surface further includes first and second sides wherein said wedging means further includes said first and second sides tapering away from each other from said inner end toward said outer end.

10. A locking removable support surface with adapter according to claim 1 wherein said adapter further includes a coupling means for coupling said adapter to a vertical surface.

11. A locking removable support surface with adapter according to claim 10 wherein said adapter further includes a rear wall spaced from said facing and coupled to said first and second side walls wherein said coupling means includes bolts perpendicular to said rear wall for passing through said vertical surface.

* * * * *